US009562672B2

(12) United States Patent
Jørgensen et al.

(10) Patent No.: US 9,562,672 B2
(45) Date of Patent: Feb. 7, 2017

(54) ILLUMINATION DEVICE WITH MULTI-COLORED LIGHT BEAM

(71) Applicant: MARTIN PROFESSIONAL A/S, Aarhus N (DK)

(72) Inventors: Dennis Jørgensen, Rønde (DK); Nina Kildeby, Gedved (DK)

(73) Assignee: MARTIN PROFESSIONAL A/S, Aarhus N (DK)

( * ) Notice: Subject to any disclaimer, the term of this patent is extended or adjusted under 35 U.S.C. 154(b) by 0 days.

(21) Appl. No.: 14/353,457

(22) PCT Filed: Oct. 19, 2012

(86) PCT No.: PCT/DK2012/050388
§ 371 (c)(1),
(2) Date: Apr. 22, 2014

(87) PCT Pub. No.: WO2013/060329
PCT Pub. Date: May 2, 2013

(65) Prior Publication Data

US 2014/0301071 A1 Oct. 9, 2014

(30) Foreign Application Priority Data

Oct. 23, 2011 (DK) ..... 2011 70579

(51) Int. Cl.
*F21V 14/06* (2006.01)
*F21V 5/00* (2015.01)
(Continued)

(52) U.S. Cl.
CPC ..... *F21V 14/06* (2013.01); *F21V 5/007* (2013.01); *F21V 5/008* (2013.01); *F21V 17/02* (2013.01);
(Continued)

(58) Field of Classification Search
CPC ..... F21V 23/003; F21V 5/007; F21V 14/06; F21V 17/02; F21V 29/004
(Continued)

(56) References Cited

U.S. PATENT DOCUMENTS 6,657,393 B2 * 12/2003 Natsume ..... 315/82
8,287,162 B2 * 10/2012 Lu et al. ..... 362/427
(Continued)

FOREIGN PATENT DOCUMENTS

CN 201180949 Y 1/2009
WO 03025458 A1 3/2003
(Continued)

OTHER PUBLICATIONS

International Search Report and Written Opinion, PCT/DK2012/050388, Jan. 17, 2013, 8 pages.
(Continued)

*Primary Examiner* — Sharon Payne
(74) *Attorney, Agent, or Firm* — Artegis Law Group, LLP

(57) ABSTRACT

The present invention relates to an illumination device comprising a number of light sources arranged in at least a first group of light sources and in a second group of light sources, where said first group of light sources and said second group of light sources are individually controllable. First and second optical means collect light from the first and second group of light sources and convert the collected light into a number of first and second light beams. The illumination device comprises further first and second zoom optics adapted to change the beam diverges and/or width of respectively the first and second light beams and the illumination device is capable of controlling the first and second zoom optics individually. The present invention relates further to a method of controlling such illumination device.

14 Claims, 10 Drawing Sheets

(51) Int. Cl.

| | |
|---|---|
| ***F21V 29/50*** | (2015.01) |
| ***F21V 17/02*** | (2006.01) |
| ***F21V 21/30*** | (2006.01) |
| *F21W 131/406* | (2006.01) |
| *F21V 29/00* | (2015.01) |
| *F21Y 101/00* | (2016.01) |

(52) U.S. Cl.
CPC ..... *F21V 21/30* (2013.01); *F21V 29/50* (2015.01); *F21V 29/004* (2013.01); *F21W 2131/406* (2013.01); *F21Y 2101/00* (2013.01); *F21Y 2105/10* (2016.08); *F21Y 2113/13* (2016.08); *F21Y 2115/10* (2016.08)

(58) Field of Classification Search
USPC ..... 362/281, 85, 231
See application file for complete search history.

(56) References Cited

U.S. PATENT DOCUMENTS

| | | | | |
|---|---|---|---|---|
| 8,496,354 | B2 * | 7/2013 | Jurik | F21V 5/008 362/279 |
| 2009/0122536 | A1 | 5/2009 | Scholz | |
| 2011/0103073 | A1 * | 5/2011 | Jurik | 362/319 |
| 2011/0235326 | A1 | 9/2011 | Yeh et al. | |

FOREIGN PATENT DOCUMENTS

| | | | |
|---|---|---|---|
| WO | 2011051129 | A1 | 5/2011 |
| WO | 2011119453 | A2 | 9/2011 |

OTHER PUBLICATIONS

Supplemental European Search Report Application No. EP12844393, dated Apr. 8, 2015.

* cited by examiner

ILLUMINATION DEVICE WITH MULTI-COLORED LIGHT BEAM

FIELD OF THE INVENTION

The present invention relates to an illumination device comprising a number of light sources and a number of optical means arranged in a housing. The number of optical means collect light from at least one of the light sources and convert the collected into a number of light beams and the light beams are emitted from said housing.

BACKGROUND OF THE INVENTION

In order to create various light effects and mood lighting in connection with concerts, live shows, TV shows, sport events or as a part on architectural installation, light fixtures creating various effects are getting more and more used in the entertainment industry. Typically entertainment light fixtures create a light beam having a beam width and a divergence and can for instance be wash/flood fixtures creating a relatively wide light beam with a uniform light distribution or it can be profile fixtures adapted to project image onto a target surface.

Light emitting diodes (LED) are, due to their relatively low energy consumption or high efficiency, long lifetime, and capability of electronic dimming, becoming more and more used in connection with lighting applications. LEDs are used in lighting applications for general illumination such as wash/flood lights illuminating a wide area or for generating wide light beams e.g. for the entertainment industry and/or architectural installations. For instance like in products like MAC101™, MAC301™, MAC401™, MAC Aura™, Stagebar2™, Easypix™, Extube™, Tripix™, Exterior 400™ series provided by the applicant, Martin Professional A/S. Further LEDs are also being integrated into projecting systems where an image is created and projected towards a target surface, for instance like in the products MAC 350 Entour™ or Exterior 400 Image Projector™ also provided by the applicant, Martin Professional A/S.

WO 2006/113745 discloses a lighting apparatus comprises a light panel having a panel frame, and a plurality of LEDs or other light elements secured to the panel frame. Lenses and/or filters are adjusted in distance from the light elements, by for example moving the lenses/filters into different slot positions of the frame, to alter characteristics of the emitted light. Focal lenses, diffusion lenses, and color filters may be used individually or in combination. A compound lens includes lens elements having different focusing characteristics arranged in a pattern can be arranged in front of the LEDs and movement of the compound lens results in synchronously movement of the different lens elements in respect to the LED. AS a consequence the focal or spread of the light changed by the different lens elements will change simultaneously. Through groupwise control of the intensity of the light elements, the different characteristics are emphasized or de-emphasized.

WO 2007/049176 discloses a plurality of light emitting diode dies (LED) with associated secondary optics, which produce different light distribution patterns, are combined to produce an efficient light source having a desired illumination pattern. By way of example, a first LED may include a lens that produces a light distribution pattern with a maximum intensity at the center while a second LED may use a lens that produces a light distribution pattern with a maximum intensity that surrounds the maximum intensity of the pattern produced by the first LED. The light from the LEDs can then be combined to produce a desired illumination pattern. Additional LEDs and lenses, e.g., having different light distribution patterns may be used if desired. Moreover, a variable current driver may be used to vary the amount of current to the different LEDs, such that the combined illumination pattern may be varied as desired.

WO 2010/084187 discloses a spotlight comprising light emitting diode modules wherein each LED module comprises at least two light emitting diodes with different light emission spectra and a light mixer, wherein each light mixer is arranged at one side of the light mixer in cooperation with an assigned LED module and each light mixer is configured to mix the different light emission spectra of the at least two LEDs of the assigned LED module to form a light beam, and wherein exit surfaces at the other side of the light mixers are arranged next to each other in a matrix with its light beams of the light mixers form a common light beam and a focusing optics for focusing the common light beam.

It is common to incorporate midair light effects into light shows. Midair effects are created by creating a well-defined light beam which is partially scattered by haze or smoke particle in the air whereby the audience can see the light beam in the air. The midair light beams are often created in the head of a moving head light fixture where the head is rotatable connected to a yoke which is rotatable connected to a base and the light beam can as a consequence be moved around in the air. Typically midair light effects are created by profile moving heads comprising projecting systems as these created a bright well defined light beam or by a hybrid of a projecting and a wash system often called beam systems. Typically beam systems has focusing properties like a projecting system, however the focusing in beam systems is not as sharp as dedicated projecting systems and the beams systems creates a more narrow light beam compared to wash lights. There is today a number of different products (e.g. The MAC 250 Beam™ or the MAC 2000 Beam™ provided by Martin Professional A/S) which is cable of providing such light beams and many of these can create light beams with variable beam diverges and/or collimated light beams having variable beam diameter's. In beam systems, the light beam can be split into multiple numbers of light beams by incorporating prisms having a number of facets into the optical system or by incorporating gobos having a number of smaller apertures. As a consequence the multiple light beams are substantially identical. Further Beam systems are based on traditional light sources as discharge lamps as midair effect requires very bright light beams having relatively narrow beam properties and LEDs have not previously by used when creating beam systems. Yet another fact is that light designers and producers continuously try to create and use new and interesting light effects in the light shows.

DESCRIPTION OF THE INVENTION

The object of the present invention is to solve the above described limitations related to prior art and provide a beam system which can create new and interesting midair effects and which also can be based on LEDs. This is achieved by an illumination device and method as described in the independent claims. The dependent claims describe possible embodiments of the present invention. The advantages and benefits of the present invention are described in the detailed description of the invention.

DESCRIPTION OF THE DRAWING

FIG. 3*a*-3*d* illustrate another embodiment of an illumination device according to the present invention;

DETAILED DESCRIPTION OF THE INVENTION

The present invention is described in view of a moving head lighting fixture including a number of LEDs that generate a light beam, however the person skilled in the art realizes that the present invention relates to illumination devices using any kind of light source such as discharge lamps, OLEDs, plasma sources, halogen sources, fluorescent light sources, etc. and/or combinations thereof. It is to be understood that the illustrated embodiments are simplified and illustrate the principles of the present invention rather than showing an exact embodiment. The skilled person will thus understand that the present invention can be embodied in many different ways and also comprise further components in addition to the shown components.

Figure 1A:
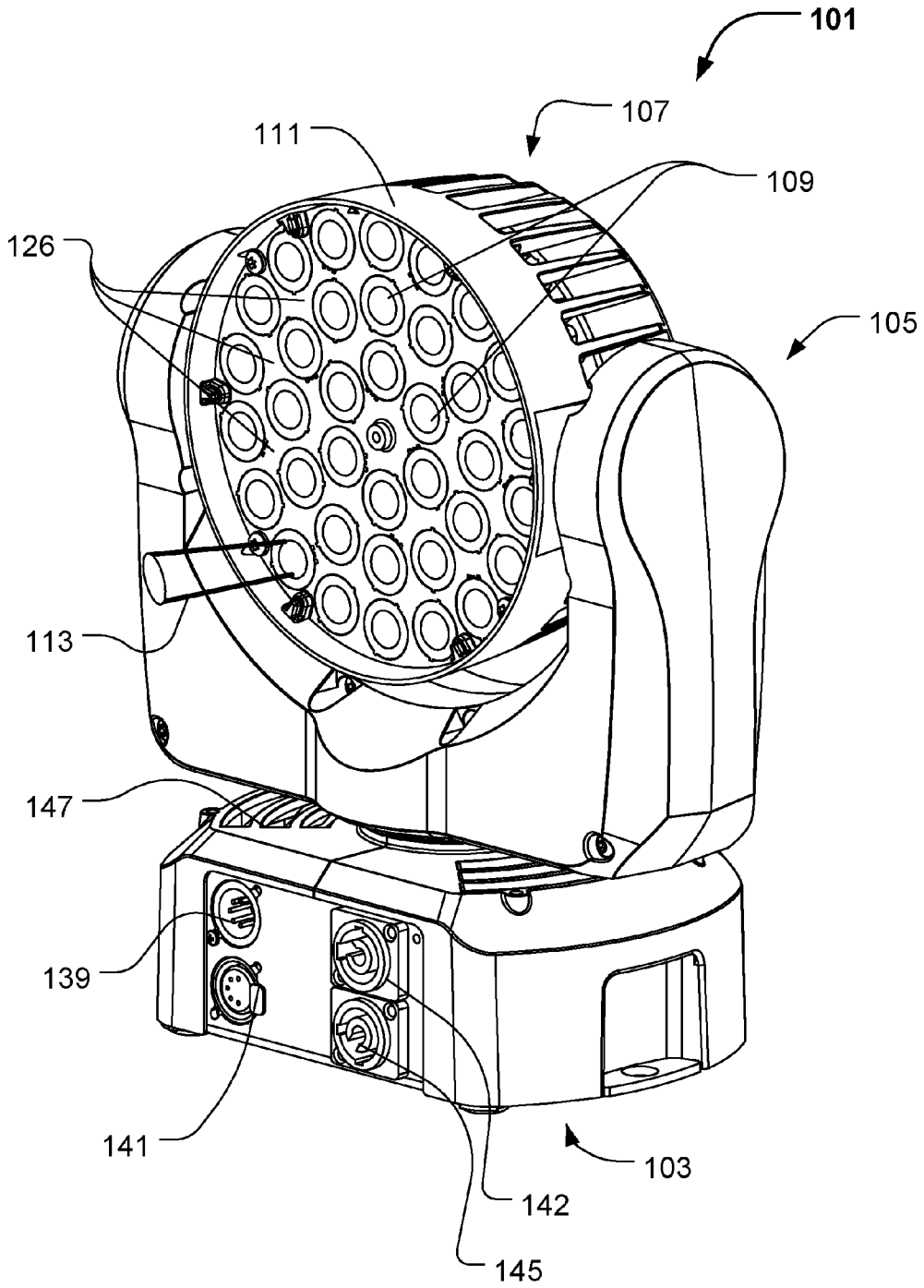
Fig. 1a (Prior art)
FIGS. 1*a* and 1*b* illustrate an example of a moving head lighting fixture according to prior art.
Figure 1B:
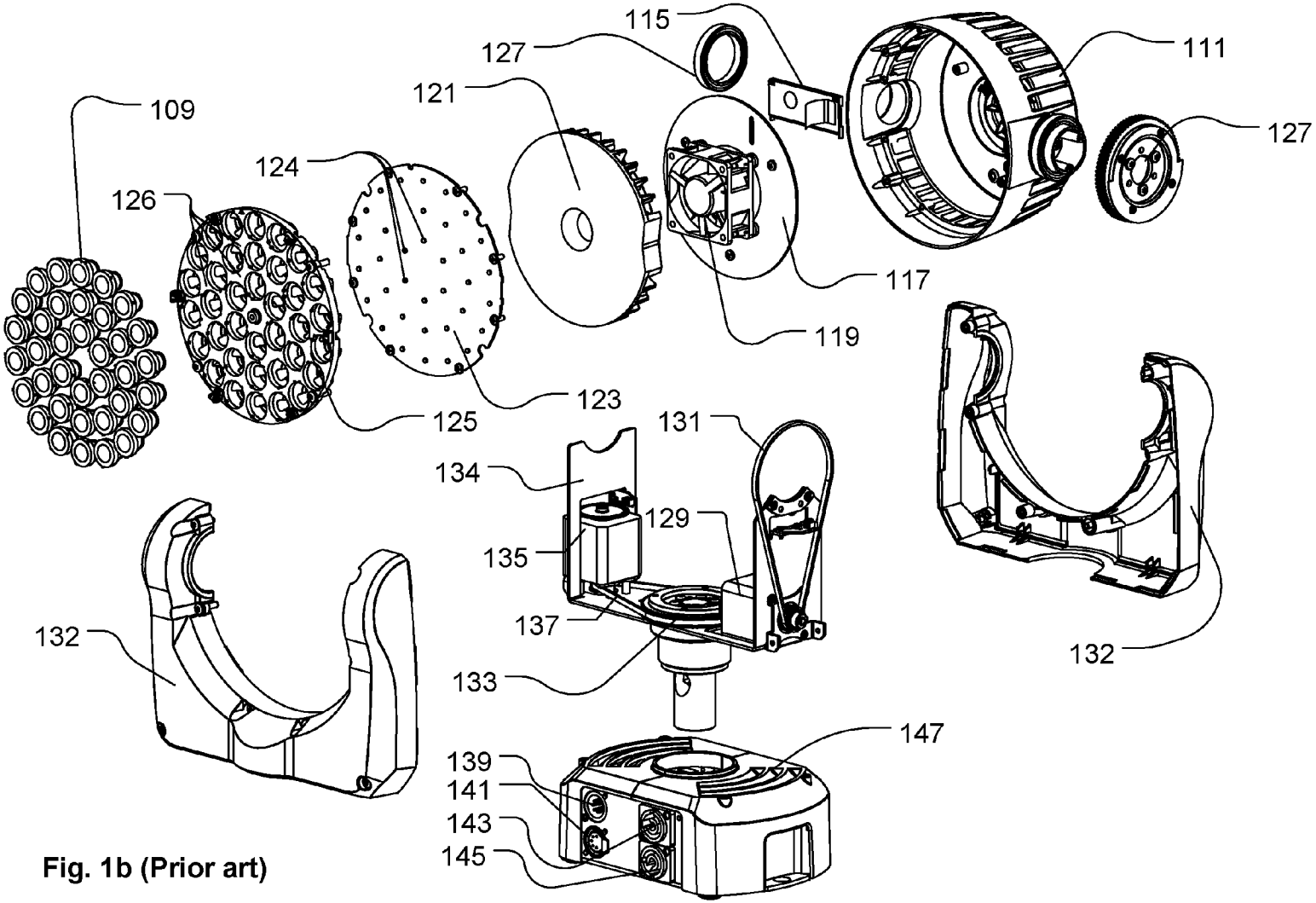
Fig. 1b (Prior art)

FIG. 1*a*-1*b* illustrate an illumination device according to prior art, where FIG. 1*a* is a perspective view and FIG. 1*b* is an exploded view. The illumination device is a moving head lighting fixture 101 comprising a base 103, a yoke 105 rotatable connected to the base and a head rotatable connected 107 to the yoke.

In the illustrated embodiment, the head comprises a number of light sources and a number of light collecting means 109 arranged in the head housing 111. The light collecting means collect light from at the light sources and convert the collected light into a number of source light beams 113 (only one illustrated), and which are emitted from the housing.

In the illustrated embodiment the head housing 107 is a "bucket" shaped head housing 111 wherein a display 115 (visible from the rear side of the head), main PCB 117 (Printed Circuit Board), a fan 119, a heat sink 121, a LED PCB 123, and a lens assembly are stacked. The LED PCB 123 comprises a number LEDs 124 and the lens assembly comprises a lens holder 125 and a lens array where the lenses constitute the light collecting means 109. Each light collecting means is adapted to collect light form each LED and convert the collected light into a light source beam 113. The head is rotatable connected to the yoke by two tilt bearings 127, which are supported by the yoke 105. A tilt motor 129 is adapted to rotate the head through a tilt belt 131 connected to one of the tilt bearings 127. The yoke comprises two interlocked yoke shell parts 132 which are mounted to a yoke frame 134 whereon the tilt bearings, tilt motor, pan motor and pan bearing are arranged. The LED PCB 123 comprises a number of LEDs emitting light and which in cooperation with the light collecting means 109 in the lens array generate a number of light source beams. The main PCB comprises controlling circuits and driving circuits (not shown) for controlling the LEDs as known in the art of illumination devices. The main PCB comprises further a number of switches (not shown) which extend through a number of holes in the head housing 111. The switches and display act as a user interface allowing a user to communicate with the moving head lighting fixture.

The yoke are connected to a pan bearing 133 rotatable connected to the base 103. A pan motor 135 is adapted to rotate the yoke through a pan belt 137 connected to the pan bearing 133. The base comprises 5-Pin XLR male 139 and female 141 connectors for DMX signals as known in the art of entertainment lighting; input 143 and output power 145 connectors, power supply PCB's (not shown) and fan (not shown). The fan forces air into the base through vent holes 147.

This prior art illumination device uses multiple LEDs to replace a single light source as known prior the introduction of the LED component as a widely used light source. However such illumination device changes its visible appearance as the multiple light sources are now exposed to the viewer and the light emits from a larger area. If the light luminaries are a color mixing version with single color LEDs, then all LED colors used are visible. However some customers dislike the look of multiple light dots. Instead a more uniform, even light exit is requested, to avoid the cheap looking "funfair" look with an extreme amount of light sources. The light beams merges into one common light beam a distance from the light collecting means. When it comes to midair effects such illumination device can only well-defined light beams having the same color. It is noted the some prior art illumination systems like the one in FIGS. 1*a* and 1*b* can comprise a zooming system enabling the user to adjust the divergence of the light beam. However LED based illumination devices are designed to have a large divergence and are thus primarily used for illuminating larger areas of e.g. a stage. The illuminating device illustrated in FIGS. 1*a* and 1*b* is just one example of a prior art illumination derive and the skilled person realize that a large number of different embodiments provided by a large number of manufactures exits.

Figure 2A:
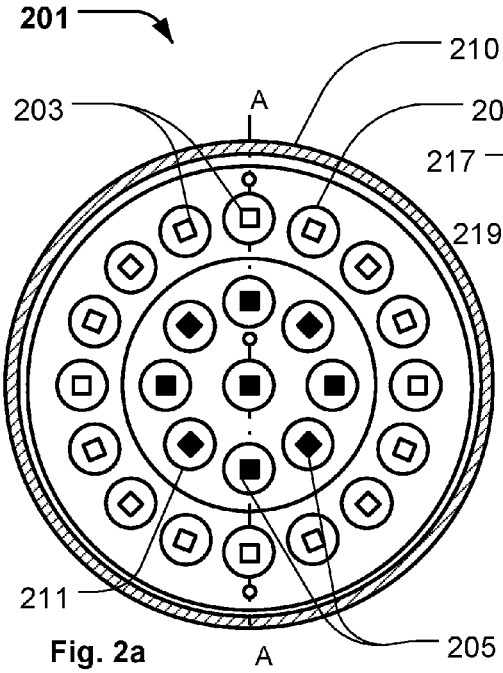
FIG. 2*a*-2*d* illustrate an embodiment of an illumination device according to the present invention.
Figure 2B:
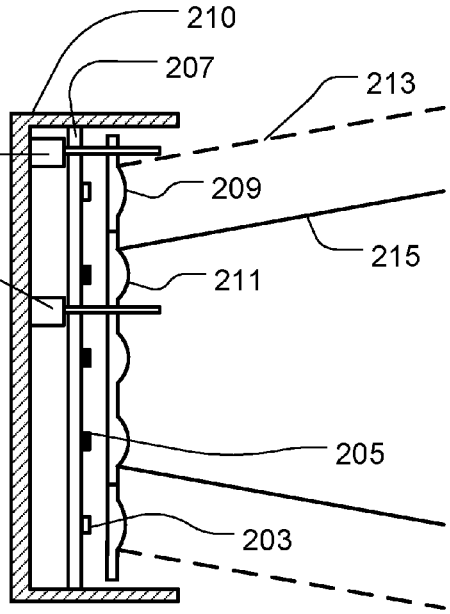
Figure 2C:
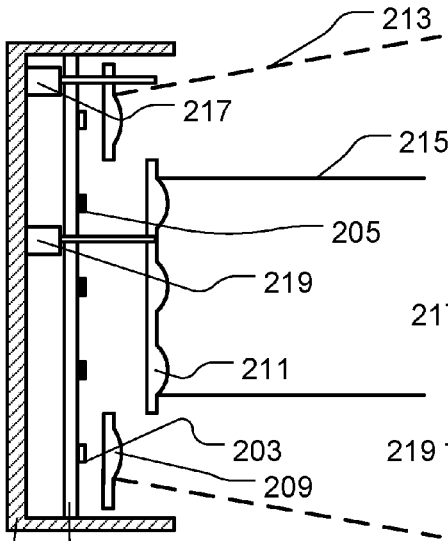
Figure 2D:
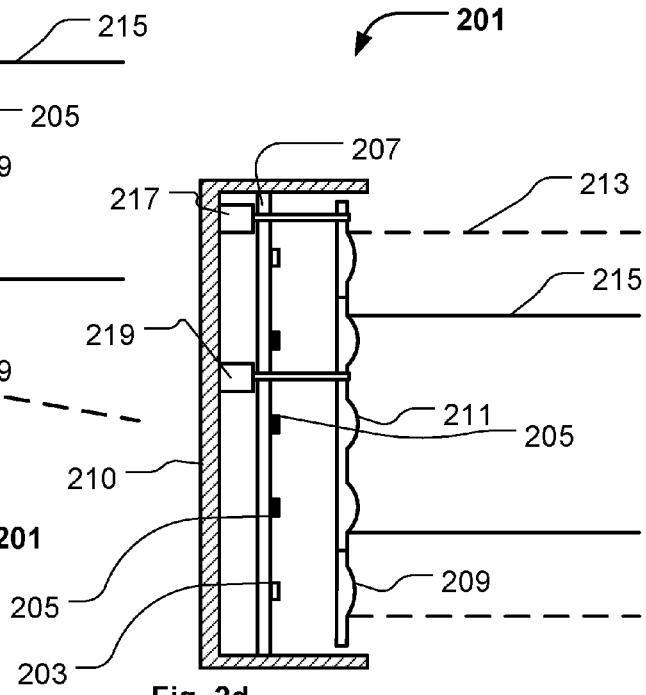

FIGS. 2*a*-*d* illustrate a simplified embodiment of the illumination device 201 according to the present invention. FIG. 2*a* illustrate a top view and FIG. 2*b*,2*c*, 2*d* illustrate a cross sectional view along line A-A in respectively a first setting, second setting and third setting.

The illumination device 201 comprises a number of light sources arranged in a first group of light sources 203 (illustrated as white quadrangles) and in a second group of light sources 205 (illustrated as black quadrangles). In this embodiment the light sources are LEDs mounted on a PCB 207 (printed circuit board) and the two groups of light sources can be controlled individually and independently of by a controller (not shown) as known in the art of lighting. The skilled person realizes that the illumination device also can be adapted to divide each group of light sources into a number of sub-groups which also can be controlled individually and that it is also possible to control each single light source individually. First and second optical means 209 and 211 are respectively arranged above the first group light sources and the second group of light sources.

The first optical means 209 is adapted to collect light from the first group of light sources and convert the collected light into a number of first light beams where the outer perimeter of the first light beams are indicated by dashed lines 213. The second optical means 211 is adapted to collect light from the second group of light sources and convert the collected light into a number of second light beams where the outer perimeter of the second light beams are indicated by solid lines 215. The mentioned components are arranged in a housing 210 and the first and second light beams are emitted from the housing. The first and second optical means can be embodied as any optical component capable of collecting light from the light sources and convert the light into light beams and can for instance be optical lenses, light mixers, TIR lenses etc.

Further the first optical means comprises first zoom optics 209 capable of changing the divergence and/or beam width of the first light beams 213 and the second optical means comprises second zoom optics 211 capable of changing the divergence and/or the beam width of the second light beams 215. The controlling means is adapted to control the first zoom optics and the second zoom optics independently. In the illustrated embodiment the first and second zoom optics are embodied as a number a plano-convex lenses embodied in two transparent plates. The first and second zoom optics are respectively connected to a first 217 and second 219 actuator, where the first actuator is adapted to move the first zoom optics in relation to the first group 203 of light sources and where the second actuator is adapted to move the second zoom optics in relation the second group 205 of light sources. The controlling means can control the actuators as known in the art of entertainment lightning. This setup makes it possible to control the zoom level of the first and second light beams independently of and at the same time control the light created by the first and second groups of light sources. The consequence is that a new and interesting midair light effect can be created as a multiple color light beam is provided where the divergence and/or beam width of the different colored light beam parts can be varied dynamically and in relation to each other. This is achieved as the intensity and/or color of the first light beam 213 can be controlled by the controlling means and the divergence and/or beam width of the first light beams can be controlled by the controller by moving the first zoom optics. At the same time the intensity and/or color of the second light beams 215 can be controlled by the controlling means and the divergence and/or second light beams width can be controlled by the second zoom optics.

The skilled person realizes that many mid-air effect can be created by such illumination device and realizes also the interesting color patterns can be created on a surfaces when the light beams are projected onto such surface. The first and second light beams will hit different areas on the surface and their mutual relationship can be changed by controlling the first and second zoom optics. The skilled person realize also that the first and second light beams may overlap in some zones and that an observer will observe these zones as a combination of the color of the first light beam and the color of the second light beam as known in the art of color mixing. For instance in the case that the first light beam is green and that the second light beam is red and they are run at approximately the same intensity (as observed by a human) then a human observer would see the overlapping zones as yellow. This can be used to divide the common light beam into further zones having a mixed color. If desired, it is also possible to minimize the appearance of mixed areas/sections by driving one of the light beams at a higher intensity than the other as the most intense light beam now will be the dominating and the less intense light beam will only be observed in non-overlapping zones. The person skilled in optics will also be able to define the optics such that the amount of overlapping zoned are minimized for instance by designing the first and second optical means such that the first and second light are substantially aligned adjacent to each other in the entire zooming range.

The top view in FIG. 2*a* illustrates that at least one of the light sources of the second group is arrange between at least two of the light sources of the first group. This makes it possible to provide the central part the light beam with a different color than the surrounding part and where the divergence and/or beam width of the central part can be varied in relation to the surrounding part of the light beam. In fact the light sources of the first group of light sources are arranged in a ring surrounding the second group of light sources. This provides a substantially symmetric multicolored light beam where the divergence and/or beam width of the central and the peripheral part can be changed independently of each other. The light beam will have the same looked from all sides which is useful when the illumination device is embodied in a head of a moving head light fixture like the one described in FIGS. 1*a* and 1*b*, as the moving head can make the multiple colored light beam movie in many directions in the air.

For instance FIG. 2*b*, FIG. 2*c* and FIG. 2*d* illustrate three different settings of the illumination device creating different multiple colored light beams. In FIG. 2*b* the first and second groups of light sources are instructed to provide light of different colors and the intensity of the light provided by the second light sources are higher than the intensity of the light provide by the first group of light sources. Further the first 209 and second 211 zoom optics are arranged at the same distance from the light sources by the first and second actuators. In this setting the first and second light sources will have the same divergence and the common light beam will appear as a light beam having another color at its center part. In FIG. 2*c* the second zoom optics 211 has been moved by the second actuator and the second light beams 215 are substantial parallel. The center part of the common light beam is thus regulated independently of the peripheral part and the center part of the common light beam is thus dynamic changed in relation the peripheral part of the common light beam. In FIG. 2*d* the first zoom optics has been moved to the same zoom level as the second zoom optics and the consequence is that a substantial parallel light beam with a parallel center of different color is created. It is noted that the settings illustrated in FIG. 2*b*-2*d* only illustrates three settings and that there are many settings and that the settings can be change dynamical whereby an unlimited number of new and interesting midair effects can be created.

Figure 3A:
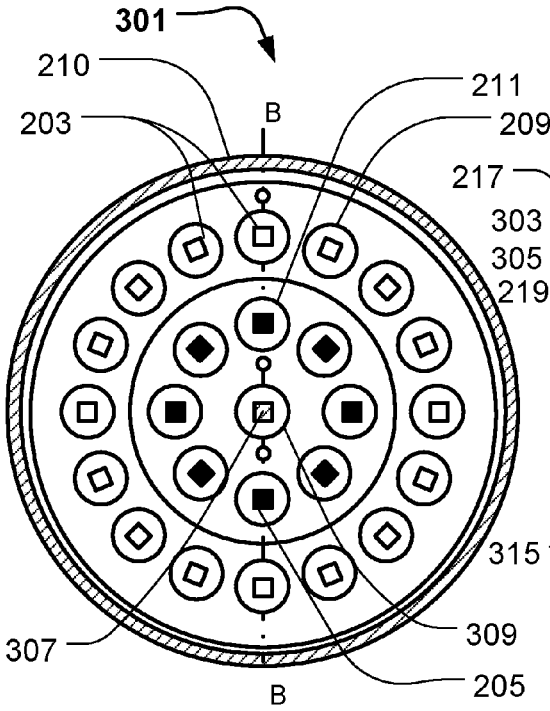
Figure 3B:
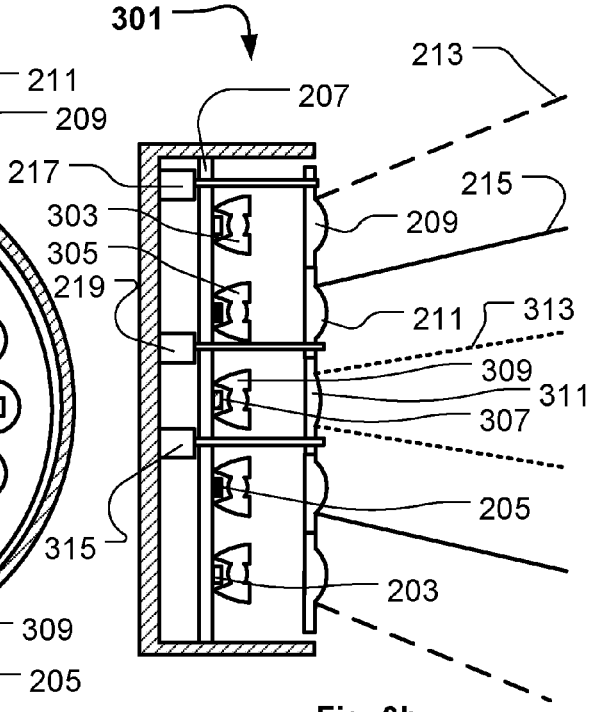
Figure 3C:
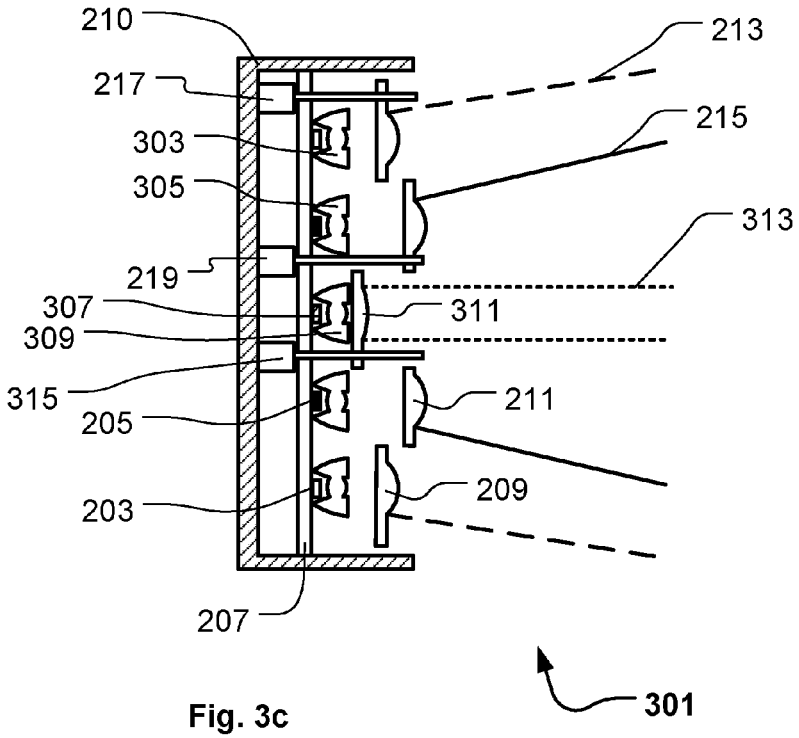

FIGS. 3*a*-*c* illustrate a simplified embodiment of another embodiment of an illumination device 301 according to the present invention. FIG. 3*a* illustrate a top view and FIG. 3*b* and FIG. 3*c* illustrate a cross sectional view along line B-B in respectively a first setting and second setting. Only the differences between the illumination device 301 and the illumination device 201 in FIG. 2*a*-*d* have been described and substantially identical components have been labeled with identical reference numbers as used in FIG. 2*a*-*d* and will not be described in this part.

In this embodiment the first optical means comprises first light collecting means 303 adapted to collect light from the first group of light sources 203 and to convert the collected light into the first light beams and where the first zoom optics 209 receives the first light beams from the first light collecting means 303. Similarly the second optical means comprises second light collecting means 305 adapted to collect light from the second group of light sources 205 and to convert the collected light into the second light beams and where the second zoom optics 211 receives the first light beams from the second light collecting means 305. The first 303 and second 305 light collecting means can be embodied as any optical component capable of collecting light from the light sources and convert the light into light beams and can for instance be optical lenses, light mixers, TIR lenses etc. The first 303 and second 305 light collecting means can collect much of the light for the light sources and form a number of light beams which can be adjusted by the first and second zoom optics. In the case that the light sources are multiple die LEDs having dies emitting different colors, the light collecting means can be embodied as light mixers capable of mixing the light form the different dies into a homogenized light beam. The first actuators is capable of moving the first zoom optics in relation to the first light collecting 303 means and the second actuators is capable of moving the second zoom optics in relation to the second light collecting means 305.

Further in this embodiment the center light sources constitute a third group 307 of light sources, which by the controlling means can be controlled independently of the other groups of light sources. Third light collecting means 309 and third zoom optics 311 are capable creating a third light beam illustrated by dotted lines 313. A third actuator 315 can move the third zoom optics whereby the divergence of the third light beam 313 can be changed.

As shown in FIGS. 3*b* and 3*c* the common light beam created by the illumination device can have three colors which can be adjusted in many ways as described above. It is to be understood that the light sources can be arranged in any number of groups and the corresponding zoom optics can be individual controlled by the controller. The skilled person will thus be able to construct a large number of illumination devices falling within the scope of the claims.

Figure 4:
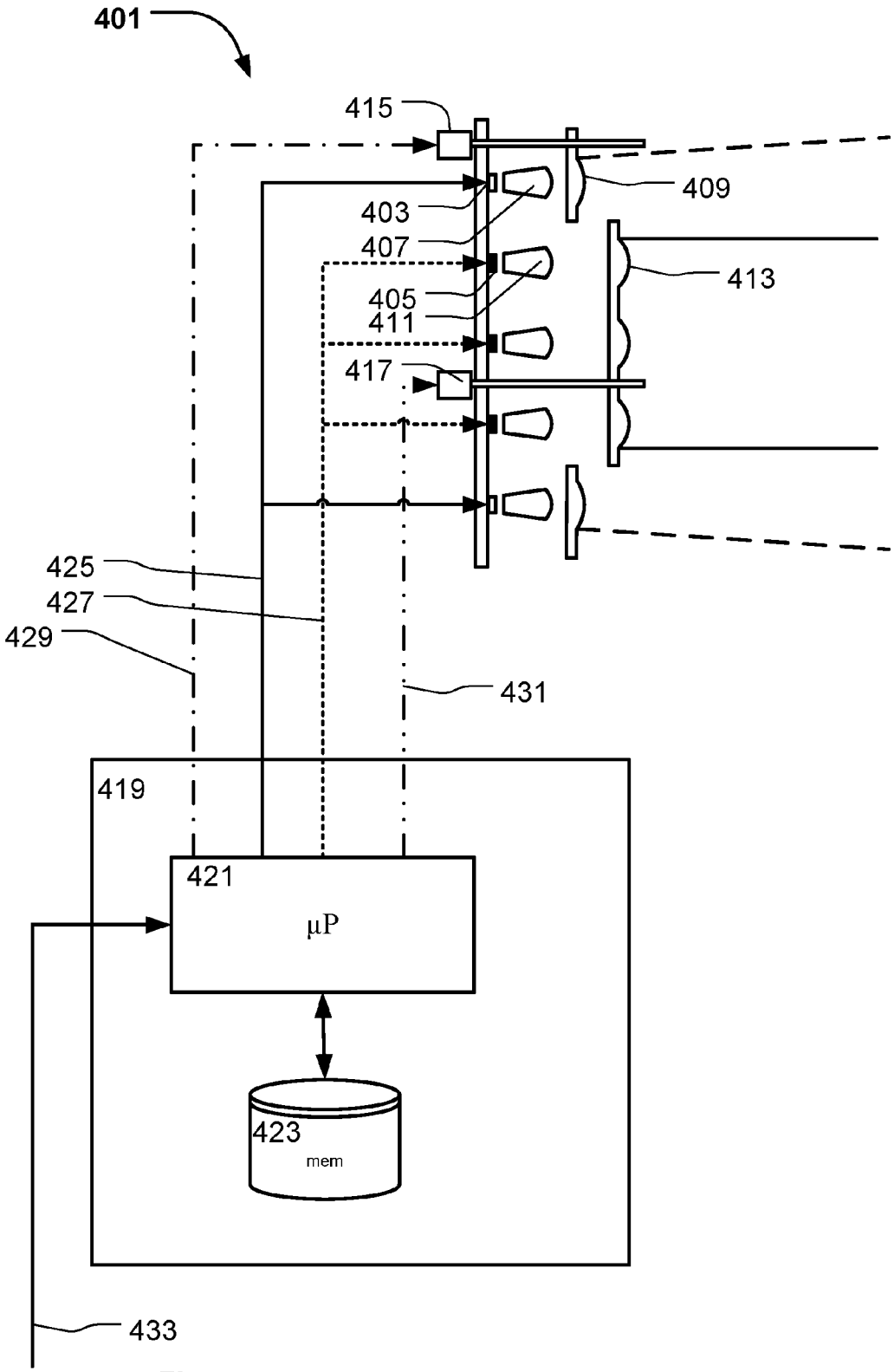
FIG. 4 illustrates a block diagram of a illumination device according to the present invention.

FIG. 4 illustrates a block diagram of an illumination device 401 according to present invention. As described above the illumination device 401 comprises a number of light sources arranged in first group of light sources 403 (white) and in a second group of light sources 405 (black) and first and second optical means. The first optical means comprises first light collectors 407 and first zoom optical means 409 and the second optical means comprises second light collectors 411 and second zoom optical means 413. Like the illumination devices illustrated in FIG. 2*a-d* and FIG. 3*a-c* the first groups of light sources are arranged as a ring around the second group of light sources. Each of the first and second groups of light sources are embodies as a multi-die LEDs comprising a number of dies emitting different color, e.g. a red die emitting red light, a blue light emitting blue light, a green die emitting green light and a white die emitting white light, however the skilled person realize that many combinations of such multi-die LED can be used. The light collectors are embodied as light mixers mixing the light from each multi-die LED into a homogeneous light beam. The light mixers can for instance be embodied as any light mixer known in the art for instance polygonal or circular light rods, conical light mixers or as described in the Danish patent application DK PA 2010 70580 titled "OPTICAL LIGHT MIXER PROVIDING A HOMOGENIZED AND UNNIFORM LIGHT BEAM" filed the 23 Dec. 2010 or in the in the PCT patent application PCT/DK2011/050450 titled "OPTICAL LIGHT MIXER PROVIDING A HOMOGENIZED AND UNNIFORM LIGHT BEAM" filed the 25 Nov. 2011 and published as WO 2012/083957. Both applications have been filed by the applicant and are incorporated herein by reference. The first zoom optics is embodied as a transparent ring with a number of lenses and are connected to a first actuator 415. The second zoom optics is embodied as a transparent disc with a number of lenses and is connected to a second actuator 417.

The illumination device comprises further a control unit 419 comprising a processor 421 and a memory 423. In the block diagram the light collecting means are positioned in the first position above the first group of light sources. The processor acts as controlling means and is adapted to control the first group of light sources 403 and the second group of light sources 405 respectively through communication means 425 (in solid lines) and 427 (in dotted lines). The processing means can thus control one of the groups of light sources without controlling the other group of light sources. The controlling means can for instance be adapted to control the color and/or intensity of the light sources and can be based on any type of communication signals known in the art of lightning e.g. PWM, AM, FM, binary signals etc. The first 403 and second 405 group of light sources can thus be controlled individually and independently and can thus be treated as two individually and independently groups of light sources. It is to be understood that the individually light sources of each groups can be controlled by the same control signal, supplied with individual control signals and/or grouped in sub-groups where each subgroup receive the same control signal. The communication means 425 and 427 are illustrated as tree connections divided into the individual light source, however the skilled person will be able to construct many embodiments of the communication means, for instance the group of light sources may be coupled in series or in parallel. Alternatively both groups of light sources can be connected to the same data bus and controlled by the controller through a data bus using addressing. Further the controlling means is adapted to control the first 415 actuator and the second 417 actuator respectively through communication means 429 (in dashed-dotted line) and 431 (in dashed-dotted-dotted) by sending instructions to the first and second actuators. These instructions can instruct the first and/or second actuator to move the first and/or second zoom optics whereby the divergence of the first and second light beams can be changed. As described above the illumination device is thus capable of creating many new and exciting mid-air effects and can also provide interesting light effects on a surface where on the light beam are projected.

The controlling means can be adapted to control the first zoom optics based on a first zoom level parameter. The first zoom level parameter is indicative of the zoom level of the first light source beams and can for instance be stored in the memory or determined based other parameters. The first zoom level parameter can also be received through an input signal 433 as described below. Similar the controlling means can be adapted to control the second zoom optics based on a second zoom level parameter. The second zoom level parameter is indicative of the zoom level of the second light source beams and can for instance be stored in the memory or determined based other parameters. The second zoom level parameter can also be received through an input signal 433 as described below. In the illustrated embodiment the controlling means are adapted to activate the first and second actuators based on the first and second zoom parameters whereby the first zoom optics and second zoom optics ere moved in relation the first and second light collectors. Alternatively the controlling means can be adapted to control the second zoom optical means based on the first zoom level parameter of whereby the second light beams can be adapted to have substantially the same beam divergence and/or width as the first light beams in this way beam divergence and/or width of the first and second light beams will be regulated identically. However it is also possible to integrate a zoom scheme such that the zoom level of the second light beams is adjusted according the zoom level of the first light beams, but such that the zoom level of the second light beams is offset of the zoom level of the first light beams. Similar the first zoom optics can be controlled based on the second zoom parameter.

Further the controlling means can be adapted to control the first group of light sources based on a first color parameter and to control the second group of light sources based on a second color parameter. The first color parameter can for instance be indicative of the color that the first group light sources shall generate, for instance RGB values, color coordinates in color maps etc. Similar the second color parameter can be indicative of the color that the second group light sources shall generate, for instance RGB values, color coordinates in color maps etc. Alternatively the controlling means can be adapted to control the second group of light sources based on the first color parameter of whereby the second group of light sources can be adapted generate substantial the same color as the color generated by the first group of light sources the light beams will in this way have the same color and appear as one common light beam and the illumination device can thus be used as a prior art illumination device. However it is also possible to integrate a color scheme such that the color of the second array is adjusted such that the color of the second group of light sources is different but esthetic matches each other according to a predetermined color scheme. Similar the first group of light sources can be controlled based on the second color parameter.

In one embodiment the controlling means is adapted to control the first group of light sources, the second group of light sources, the first zoom optical means (through the first actuator) and second zoom optical means (through the second actuator) based on an input signal 433 indicative of a number of controlling parameters as known in the art of entertainment lighting. The input signal 433 can be any signal capable of communication of parameters and can for instance be based on one of the following protocols USITT DMX 512, USITT DMX 512 1990, USITT DMX 512-A, DMX-512-A including RDM as covered by ANSI E1.11 and ANSI E1.20 standards or Wireless DMX. ACN designates Architecture for Control Networks; ANSI E1.17-2006). The input signal can for instance be indicative of the first zoom level parameter; second zoom level parameter; the first color parameter and/or the second color parameter.

A number of predefined effect functions can also be stored in the memory and for instance comprise a number of instructions on how the zoom level of the first and second zoom optical means are regulated in relation to each other. These predefined effect functions can for instance be executed and combined as described in the Danish patent applications DK PA 2011 00665 and DK PA 2011 00666 respectively titled "METHOD OF PRIORITIZING EFFECT FUNCTIONS IN AN ILLUMINATION DEVICE" and METHOD OF SYNCHRONIZING EFFECT FUNCTIONS IN AN ILLUMINATION DEVICE. Both applications filed by the applicant the $2^{nd}$ Sep. 2011 and incorporated herein by reference. Or alternatively as described in the PCT patent application PCT/DK2012/050326 titled "PRIORTIZING AND SYNCHRONIZING EFFECT FUNCTIONS" filed the $31^{st}$ of August 2012 by the applicant and incorporated herein by reference.

The illumination device according to the present invention can also be integrated with an illumination device as described in the patent application, PCT/2011/050110 (WO 2011/131197) titled "LED LIGHT FIXTURE WITH BACKGROUND LIGHTING" filed $5^{th}$ of Apr. 5, 2011 by the applicant and incorporated herein by reference. In such embodiment an additional group of background light sources can be adapted to illuminate diffusing means in areas between the light beams. The background light sources can provide background light between the light beams through a number of light guides as described in the patent application PCT/2011/050112 (WO 2011/131199) titled "LED LIGHT FIXTURE WITH BACKGROUND LIGHT EFFECTS" filed by the applicant the $5^{th}$ of Apr. 5 2011. Alternatively the background light sources can constitute pixels in a background display as described in the patent application PCT/2011/050120 (WO 2011/131200) titled "LED LIGHT FIXTURE WITH BACKGROUND DISPLAY EFFECTS" filed by the applicant the $12^{th}$ of Apr. 5, 2011.

It is noted that the light sources of the first and second can be different and the optical properties of the first and second optic means also can be different and that the person skilled in the art of optics can is choosing and/or these components according to specified requirements.

Figure 5A:
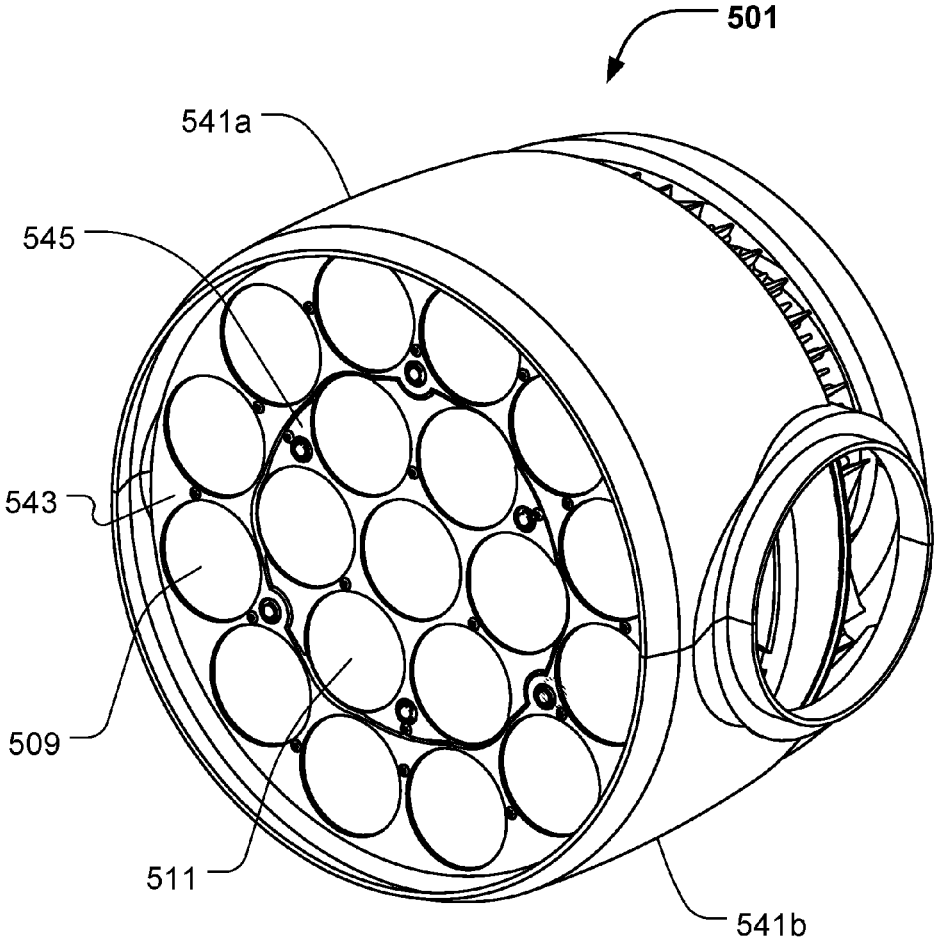
FIGS. 5*a* and 5*b* illustrate another embodiment of an illumination device according to the present invention.
Figure 5B:
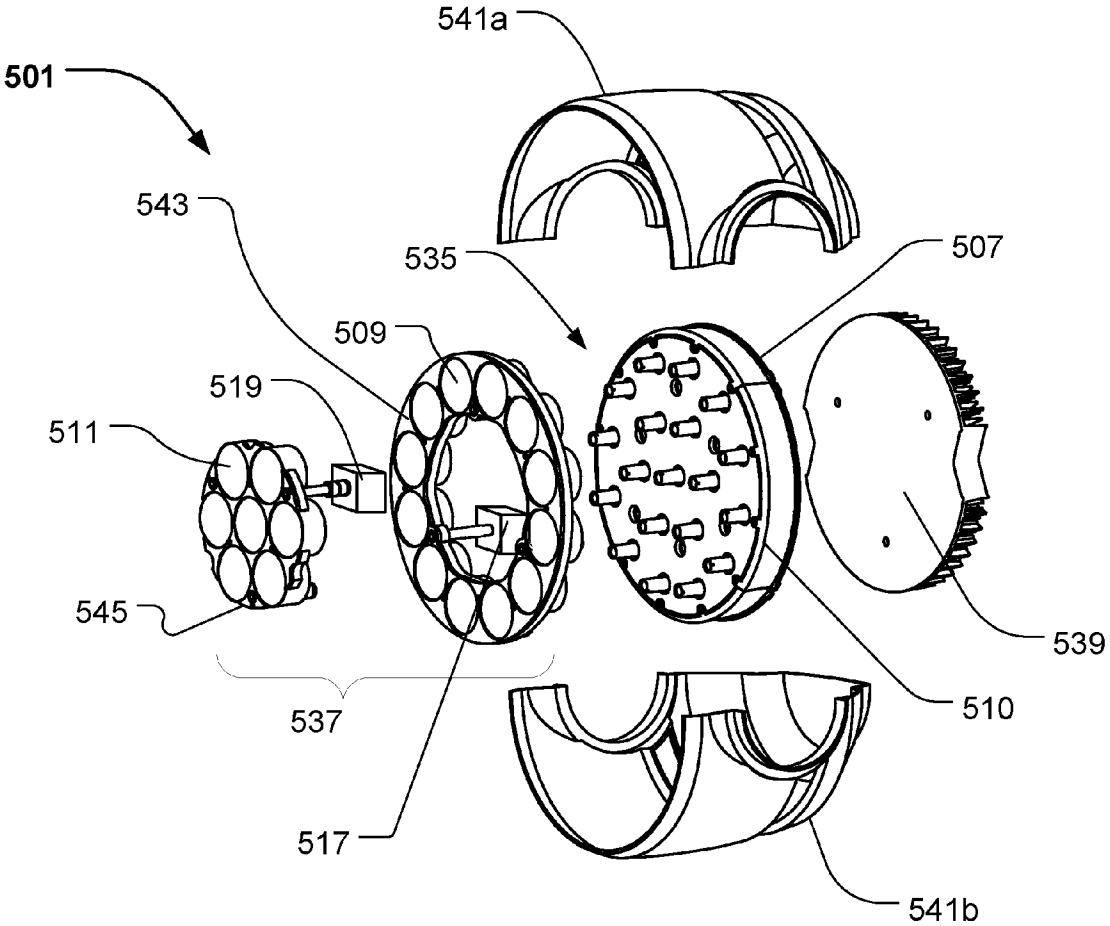

FIGS. 5*a* and 5*b* illustrate another embodiment of the illumination device 501 according to the present invention. FIG. 5*a* illustrates a perspective view and FIG. 5*b* illustrates an exploded view.

In this embodiment the illumination device comprises a light source module 535, a zoom module 537 and a cooling module 539. The three modules are arranged in a housing comprising a first housing shell 541*a* and a second housing shell 541*b*, however the skilled person realize that the housing can be constructed in many different alternative ways can comprise any number of shells. In the illustrated embodiment the housing is formed as a head suitable to be rotatable connected to a yoke of a moving head light fixture as known in the art of moving head light fixtures and for instance as described in FIG. 1 *a-b*.

Figure 6:
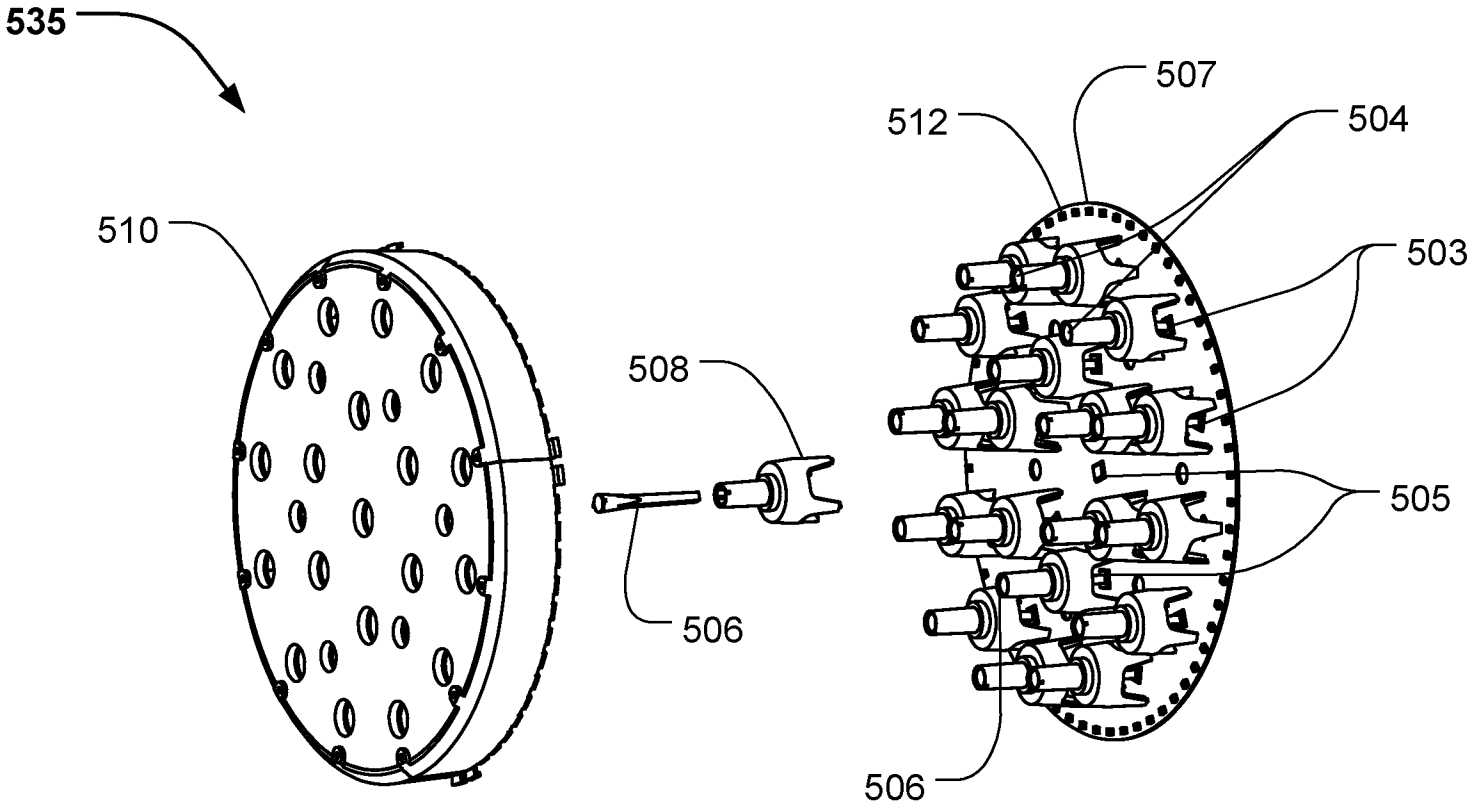
FIG. 6 illustrates an embodiment of the LED and light collecting means of the illumination device in FIGS. 5*a* and 5*b;*

The light source module 535 is shown in FIG. 6 and comprises a first group of light sources and second group of light sources mounted on a PCB 507. The two groups of light sources can be controlled individually and independently by a controller (not shown) as known in the art of lighting. In this embodiment the first group of light sources comprises 12 LEDs 503 arranged in a ring surrounding the second group of light sources, which comprises 7 LEDs 505. However it is noted that any number of light sources can be provided. The LEDs are multi die LEDs each comprising a plurality of LED dies emitting different colors, whereby each LED can provide a large number of colors due to additive color mixing.

First light collecting means 504 are adapted to collect light from the first group of light sources 503 and to convert the collected light into the first light beams. Similarly second light collecting means 506 are adapted to collect light from the second group of light sources 505 and to convert the collected light into the second light beams. For instance for illustrative purpose the center light collecting means have been exploded and illustrated that light collecting means is embodied as a light mixer which is supported by a light collecting means support 508. In the illustrated embodiment the first and second groups of LEDs are embodied using same kind of multi die LEDs and the light collecting means are also of the same. However it is noticed that different kind of LED and light collector can be provided in other embodiments.

The light collecting means and light collecting means are adapted to extend through a light guide plate 510, which receives light from a number of background light sources embodied as a number of backgrounds LED 512 arrange at the peripheral surface of the PCT 507. The light guide plate 501 is adapted to receive light from the background LEDs and guide the light from the background LEDs and to the areas between the light collecting means. Hereby the areas between the light collecting means are illuminated. The light guide plate 510 functions thus as a background lighting as described in patent applications WO 2011/131197 and WO 2011/131199.

Returning to FIGS. 5*a* and 5*b* the zoom module 537 comprises first zoom optics 509 and second zoom optics 511. The first zoom optics 509 receive the first light beams from the first light collecting means 504 and can be moved by a first actuator 517 whereby the divergence of the first light beams can be changed. Similar, the second zoom optics 511 receive the second light beams from the second light collecting means 506 and can be moved by a second actuator 519, whereby the divergence of the second light beams can be changed.

In the illustrated embodiment the first and second zoom optics are embodied as a number of optical lenses respectively supported by a first 543 and a second 545 lens holder, where the first lens holder 543 and second 545 lens holder respectively are connected to and movable by the first actuator 517 and the second actuator 519. It is noticed the first and second zoom optical means each also can be embodied as a transparent bodies (for instance molded in polymer or glass) wherein the lens properties are formed.

FIG. 7*a*-7*d* illustrate the illumination device of FIGS. 5*a*, 5*b* and 6 in four different settings, where outer perimeters of the first light beams are indicated by dashed lines 513 and the outer perimeters of the second light beams are indicated by solid lines 515.

Figure 7A:
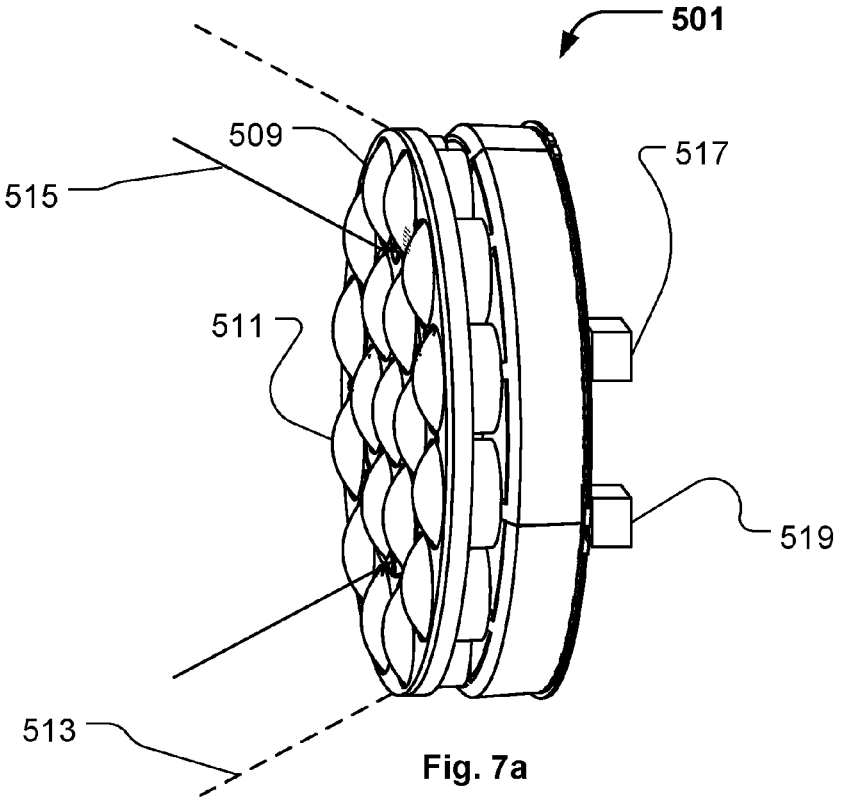
FIG. 7*a*-7*d* illustrate different settings of the illumination device of FIGS. 5*a* and 5*b*.

In FIG. 7*a* the first 509 and second 511 zoom optics are arranged closest to and at the same distance from the light collecting means 504 and 506 s by the first 517 and second 519 actuators. In this setting the first and second light sources will have the same divergence and provide the widest light beam. If the first and second groups of light sources are instructed to provide light of different colors the common light beam will appear as a light beam having another color at its center part. However it is also possible to drive the first and second group of light sources at the same color whereby the light beam will appear as a one color light beam.

Figure 7B:
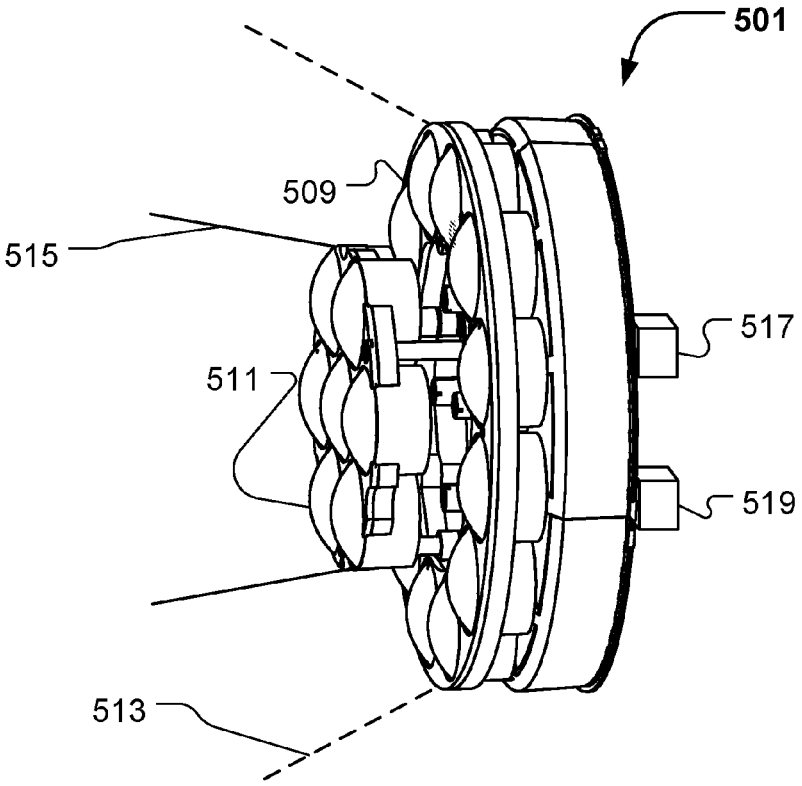

In FIG. 7*b* the second zoom optics 511 has been moved away from the light collectors by the second actuator and the second light beams are in the narrowest position. The center part of the common light beam is thus regulated independently of the peripheral part and the center part of the common light beam is thus dynamic changed in relation the peripheral part of the common light beam.

Figure 7C:
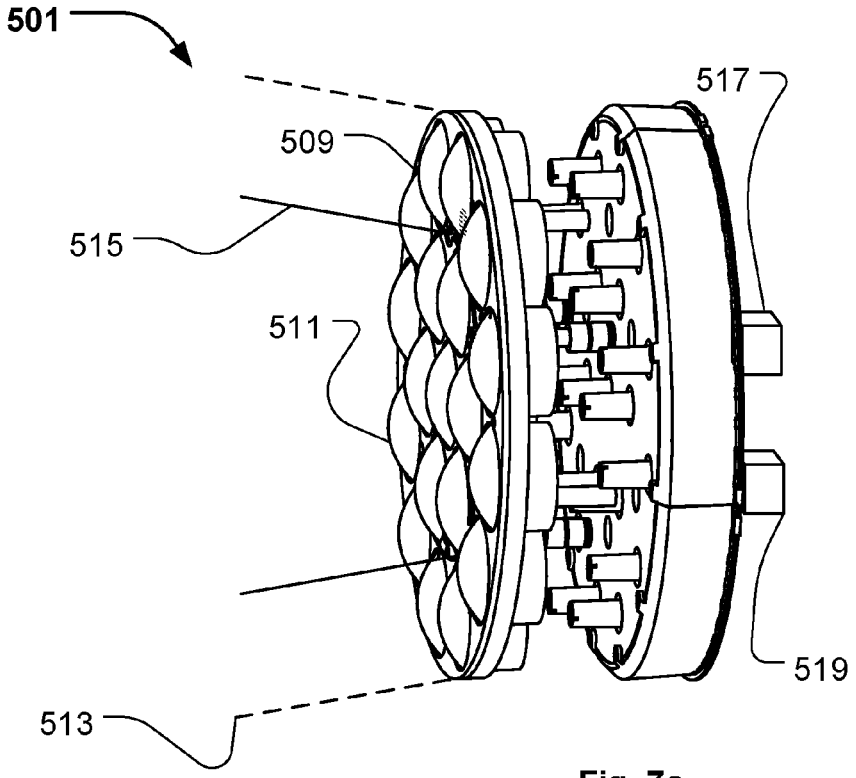

In FIG. 7*c* the first zoom optics has been moved to the same zoom level as the second zoom optics and the consequence is that the common light beam is in it's narrowest position.

Figure 7D:
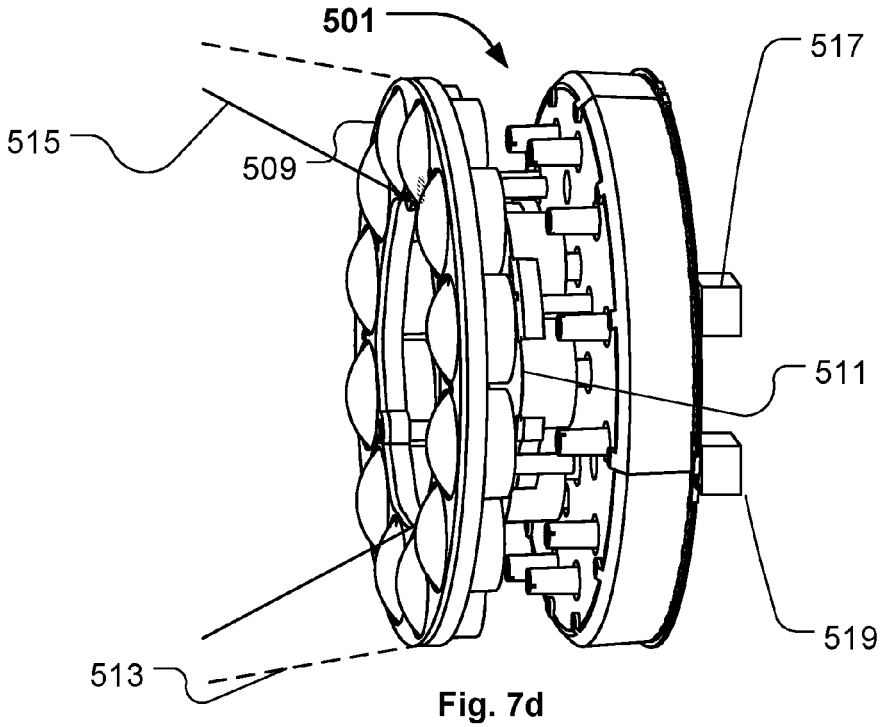

In FIG. 7*d* the second zoom optics 511 has been moved back towards the light collectors by the second actuator and the second light beams are in the widest position, whereas the peripheral part of the light beam are in the narrowest positions. This provides the effect that the center part eventually due to the fact that it has a larger divergence would extend the peripheral part a distance away from the illumination device.

It is noted that the settings illustrated in FIG. 7*a*-7*d* only illustrates four outer settings and that there are many intermediate settings and that the settings can be change dynamical whereby an unlimited number of new and interesting midair effects can be created.

In the embodiment illustrated in FIG. 5-7 the optical properties of the first and second zoom optics are substantial identical, which makes it possible to control the first and second light beam approximately the same zoom range. However it is understood that the optical properties of the first and second zoom optics may be different in other embodiments.

The invention claimed is:

1. An illumination device, comprising:

a number of light sources arranged in at least a first group of light sources and in a second group of light sources;

controlling means adapted to control said first group of light sources and said second group of light sources independently of each other;

first optical means adapted to convert light from said first group of light sources into a number of first light beams;

second optical means adapted to convert light from said second group of light sources into a number of second light beams, wherein said first optical means is not configured to collect light from said second group of light sources, and said second optical means is not configured to collect light from said first group of light sources;

wherein said first optical means comprises first zoom optics capable of changing at least one of a divergence and a beam width of said first light beams, said second optical means comprises second zoom optics capable of changing at least one of a divergence and a beam width of said second light beams, and said controlling means is adapted to control said first zoom optics and said second zoom optics independently, wherein at least one of said light sources of said second group of light sources is arranged between at least two of said light sources of said first group of light sources, and wherein said light sources of said first group of light sources and said first zoom optics are arranged in a ring surrounding said second group of light sources and said second zoom optics.

2. The illumination device of claim 1, wherein said first zoom optics is movable in relation to said first group of light sources, said second zoom optics is movable in relation to said second group of light sources, and said first zoom optics and said second zoom optics can be moved independently.

3. The illumination device of claim 1, wherein at least one of:

said first optical means comprises first light collecting means adapted to collect light from said first group of light sources and convert said collected light into said number of first light beams, wherein said first zoom optics receives said first light beams from said first light collecting means; and said second optical means comprises second light collecting means adapted to collect light from said second group of light sources and convert said collected light into said number of second light beams, wherein said second zoom optics receives said second light beams from said second light collecting means.

4. The illumination device of claim 3, wherein said first zoom optics is movable in relation to said first light collecting means and said second zoom optics is movable in relation to said second light collecting means, and in that said first zoom optics and said second zoom optics can be moved independently.

5. The illumination device of claim 1, wherein said controlling means is adapted to control at least one of said first zoom optics based on a first zoom level parameter, and said second zoom optics based on a second zoom level parameter.

6. The illumination device of claim 1, wherein said controlling means is adapted to control at least one of said first group of light sources based on a first color parameter, and said second group of light sources based on a second color parameter.

7. The illumination device of claim 5, wherein said controlling means receives an input signal indicative of at least one of said first zoom level parameter, said second zoom level parameter, said first color parameter, and said second color parameter.

8. The illumination device of claim 1, further comprising:

a base;

a yoke rotatably coupled to said base; and a head rotatably coupled to said yoke, wherein said head includes the light sources, the first optical means, and the second optical means.

9. A method of controlling an illumination device, said illumination device comprising a number of light sources arranged in at least a first group of light sources and in a second group of light sources, first zoom optics adapted to convert light from said first group of light sources into a number of first light beams, and second zoom optics adapted to convert light from said second group of light sources into a number of second light beams, wherein at least one of said light sources of said second group of light sources is arranged between at least two of said light sources of said first group of light sources, and wherein said light sources of said first group of light sources and said first zoom optics are arranged in a ring surrounding said second group of light sources and said second zoom optics, said method comprising:

controlling said first group of light sources and said second group of light sources independently;

controlling at least one of a beam divergence and a width of said first light beams using said first zoom optics;

controlling at least one of a beam divergence and a width of said second light beams using said second zoom optics, wherein said first zoom optics are not configured to collect light from said second group of light sources, and said second zoom optics are not configured to collect light from said first group of light sources; and controlling said first zoom optics and said second zoom optics independently of each other.

10. The method of claim 9, wherein at least one of:

said step of controlling at least one of the beam divergence and the width of said first light beams comprises moving said first zoom optics in relation to said first light sources; and said step of controlling at least one of the beam divergence and the width of said second light beams comprises moving said second zoom optics in relation to said first light sources, wherein moving said first zoom optics in relation to said first light sources and moving said second zoom optics in relation to said second light sources can be performed independently.

11. The method of claim 9, wherein at least one of:

said step of controlling at least one of the beam divergence and the width of said first light beams is based on a first zoom level parameter; and said step of controlling at least one of the beam divergence and the width of said second light beams is based on a second zoom level parameter.

12. The method of claim 9, further comprising at least one of:

controlling said first group of light sources based on a first color parameter; and controlling said second group of light sources based on a second color parameter.

13. The method of claim 9, further comprising receiving an input signal, wherein said input signal is indicative of at least one of said first zoom level parameter, said second zoom level parameter, said first color parameter, and said second color parameter.

14. An illumination device comprising:

a number of light sources arranged in at least a first group of light sources and in a second group of light sources;

a processer that controls said first group of light sources and said second group of light sources independently of each other;

first optics that convert light from said first group of light sources into a number of first light beams;

second optics that convert light from said second group of light sources into a number of second light beams, wherein said first optics are not configured to collect light from said second group of light sources, and said second optics are not configured to collect light from said first group of light sources;

wherein said first optics comprise first zoom optics that change at least one of a divergence and a beam width of said first light beams, said second optics comprise second zoom optics that change at least one of a divergence and a beam width of said second light beams, and said processer controls said first zoom optics and said second zoom optics independently, wherein at least one of said light sources of said second group of light sources is arranged between at least two of said light sources of said first group of light sources, and wherein said light sources of said first group of light sources and said first zoom optics are arranged in a ring surrounding said second group of light sources and said second zoom optics.

* * * * *